US006383066B1

(12) United States Patent
Chen et al.

(10) Patent No.: US 6,383,066 B1
(45) Date of Patent: May 7, 2002

(54) MULTILAYERED POLISHING PAD, METHOD FOR FABRICATING, AND USE THEREOF

(75) Inventors: Shyng-Tsong Chen, Patterson, NY (US); Alex Siu Keung Chung, Marlborough; Oscar Kai Chi Hsu, Chelmsford, both of MA (US); Kenneth P. Rodbell, Sandy Hook, CT (US); Jean Vangsness, Stow, MA (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/599,514

(22) Filed: Jun. 23, 2000

(51) Int. Cl.[7] ..... B24D 11/00
(52) U.S. Cl. ..... 451/532; 451/533
(58) Field of Search ..... 451/526, 527, 451/528, 529, 530, 531, 532, 536, 533; 51/299, 297

(56) References Cited

U.S. PATENT DOCUMENTS

| | | | | |
|---|---|---|---|---|
| 5,876,269 A | * | 3/1999 | Torii | 451/41 |
| 5,876,490 A | | 3/1999 | Ronay | |
| 5,968,280 A | | 10/1999 | Ronay | |
| 5,984,769 A | | 11/1999 | Bennett et al. | |
| 5,989,111 A | | 11/1999 | Lamphere et al. | |
| 6,051,496 A | | 4/2000 | Jang | |
| 6,069,080 A | * | 5/2000 | James et al. | 438/691 |
| 6,099,954 A | * | 8/2000 | Urbanavage et al. | 428/314.2 |

* cited by examiner

*Primary Examiner*—Timothy V. Eley
*Assistant Examiner*—Dung Van Nguyen
(74) *Attorney, Agent, or Firm*—Connolly Bove Lodge & Hutz, LLP; Robert M. Trepp, Esq.

(57) ABSTRACT

A multilayered polishing pad especially suitable for chemical-mechanical polishing or planarizing metal, semiconductor or optical surfaces is provided. The invention allows the mechanical and polishing properties of the several layers to be independently varied.

14 Claims, 1 Drawing Sheet

Pan W

Pedro

DNW 1

DNW 2

DNW 3

DNW 4

MULTILAYERED POLISHING PAD, METHOD FOR FABRICATING, AND USE THEREOF

FIELD OF THE INVENTION

The present invention relates to polishing pads. The polishing pads of the present invention are especially useful in chemical-mechanical planarization of semiconductor wafers. Specifically the invention relates to pads of increased stiffness to prevent over polishing. The present invention is also applicable to the polishing of other surfaces for example optical glass and CRT and flat panel display screens. The present invention further relates to methods for fabricating the pads and processes using them.

BACKGROUND OF INVENTION

For many years, optical lenses and semiconductor wafers have been polished by chemical-mechanical means. More recently, this technique has been applied as a means of planarizing intermetal dielectric layers of silicon dioxide and for removing portions of conductive layers within integrated circuit devices as they are fabricated on various substrates. For example, a conformal layer of silicon dioxide may cover a metal interconnect such that the upper surface of the layer is characterized by a series of non-planar steps corresponding in height and width to the underlying metal interconnects.

The rapid advances in semiconductor technology has seen the advent of very large scale integration (VLSI) and ultra large scale integration (ULSI) circuits resulting in the packing of very many more devices in smaller areas in a semiconductor substrate. The greater device densities require greater degrees of planarity to permit the higher resolution lithographic processes required to form the greater number of devices having smaller features incorporated in current designs. Moreover, copper, because of its low resistance, is increasingly being used as interconnects. Conventionally, etching techniques are used to planarize conductive (metal) and insulator surfaces. However, certain metals, desirable for their advantageous properties when used as interconnects (Au, Ag, Cu) are nor readily amenable to etching, thus the need for chemical-mechanical polishing (CMP).

Typically, the various metal interconnects are formed through lithographic or damascene processes. The darnascene technique is described in U.S. Pat. No. 4,789,648, Chow, et al. assigned to the assignee of the present invention, disclosure of which is incorporated herein by reference. For example, in a lithographic process, a first blanket metal layer is deposited on a first insulating layer, following which, electrical lines are formed by subtractive etching through a first mask. A second insulating layer over the first metallized layer, and holes are patterned into the second insulating layer using a second mask. Metal columns or plugs are formed by filling the holes with metal. A second blanket metal layer is formed over the second insulating layer, the plugs electrically connecting the first and second metal layers. The second metal layer is masked and etched to form a second set of electrical lines. This process is repeated as required to generate the desired device.

Presently, VLSI uses aluminum for the wiring and tungsten for the plugs because of their susceptibility to etching. However, the resistivity of copper is superior to either aluminum or tungsten, making its use desirable, but copper does not have desirable properties with respect to etching.

Variations in the heights of the upper surface of the intermetal dielectric layer have several undesirable characteristics. The optical resolution of subsequent photolithographic processing steps may be degraded by non-planar dielectric surfaces. Loss of optical resolution lowers the resolution at which lines may be printed. Moreover, where the step height is large, the coverage of a second metal layer over the dielectric layer may be incomplete, leading to open circuits.

In view of these problems, methods have been evolved to planarize the upper surfaces of the metal and dielectric layers. One such technique is chemical-mechanical polishing (CMP) using an abrasive polishing agent worked by a rotating pad. A chemical-mechanical polishing method is described in U.S. Pat. No. 4,944,836, Beyer, et al., assigned to the assignee of the present invention, disclosure of which is incorporated herein by reference. Conventional polishing pads are made of a uniform material, such as polyurethane, or may be laminated with variations of physical properties throughout the thickness of the pad.

The CMP art combines the chemical conversion of the surface layer to be removed, with the mechanical removal of the conversion product. Ideally, the conversion product is soft, facilitating high polishing rates. CMP pads must resolve two constraints relevant to the present invention. The surface in contact with the substrate to be polished must be resilient. Of particular relevance to the present invention is the problem of local over polishing, also known as "dishing." This is one of the key problems encountered during CMP of metal substrates. It is generally known that prevention of dishing requires a stiffer pad. However, associated with stiffer pads is the tendency towards increased number and density of surface scratches and defects. Such defects correlate with low yields of product.

Currently, these problems are handled using multi-step techniques wherein initial polishing is effected at a high rate using one set of pads and abrasive compounds, followed by a second polishing step using a second set of pads and abrasive compounds differently optimized in comparison to the first set. This is a time consuming process and, moreover, it also suffers from high defect densities due to the use of two different pads. For Cu planarization, CMP pads are critical, and are as important as the abrasive slurry. The prior art was a single-layered pad that was either too stiff or too soft to obtain good planarization.

Stacked nonwoven and other types of pads have previously been tried in an attempt to obtain better CMP performance. However, thin (5 to 15 mil thick) fibrous pads are not sufficiently durable and do not survive the CMP process.

Accordingly, the need exists for improved polishing pads.

SUMMARY OF INVENTION

The present invention addresses problems in the prior art and provides a multiple-layer pad comprising one or more stiff layers supporting a soft polishing layer. Applications are envisioned in the semiconductor and optical industries.

The invention provides a pad having one, or more, first layers comprising first fibers in a matrix and one or more second layers comprising second and different fibers embedded in a matrix and acting as the polishing layer. The composition of the first fibers and matrix is stiffer than the composition of the second fibers and matrix.

The present invention also relates to a method of using the above disclosed pads. In particular, the method comprises contacting the surface to be polished with the above disclosed polishing pad.

The present invention provides a method for making the pads. The method comprises providing a structure of at least one first layer of first fibers and at least second layer of second and different fibers. A curable polymeric composition is applied to the above structure and then heat and pressure are applied to cure the polymeric composition.

Still other objects and advantages of the present invention will become readily apparent by those skilled in the art from the following detailed description, wherein it is shown and described preferred embodiments of the invention, simply by way of illustration of the best mode contemplated of carrying out the invention. As will be realized the invention is capable of other and different embodiments, and its several details are capable of modifications in various obvious respects, without departing from the invention. Accordingly, the description is to be regarded as illustrative in nature and not as restrictive.

DESCRIPTION OF DRAWINGS

The FIGURE is a set of SEM cross-sections comparing pads of the present invention to prior art pads.

BEST AND VARIOUS MODES FOR CARRYING OUT PRESENT INVENTION

Figure 1A:
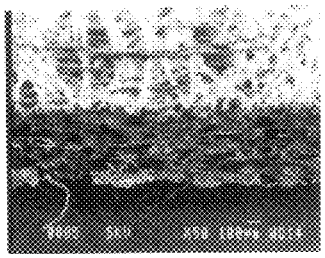
Figure 1B:
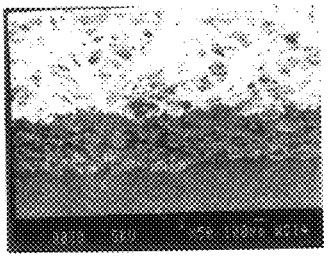
Figure 1C:
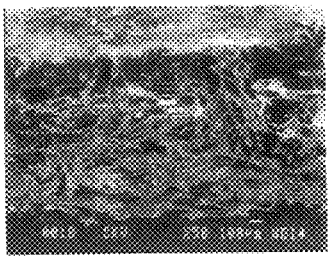
Figure 1D:
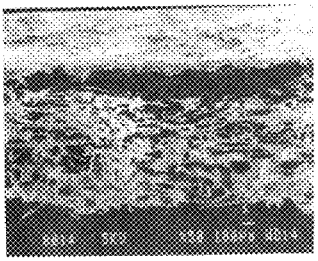
Figure 1E:
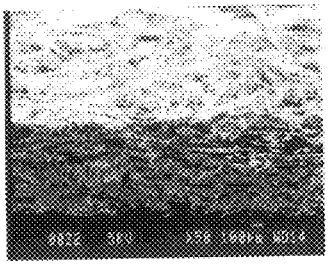
Figure 1F:
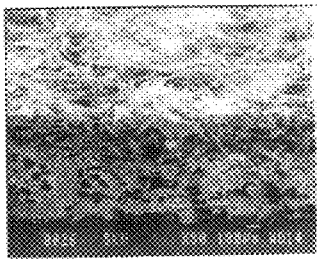

The polishing pads of the present invention comprise one, or more, first layers comprising first fibers in a matrix and one or more second layers comprising second and different fibers embedded in a matrix and acting as the polishing layer. The composition of the first fibers and matrix is harder and more rigid than the composition of the second fibers and matrix. The first fibers and matrix typically have a stiffness of about 40 Shore A to about 100 Shore A and preferably about 60 Shore A to about 80 Shore A as measured by Durometer Hardness test method ASTM D2240. Typical materials suitable as the first fibers are polyester, Rayon, polycarbonate, Aramide fibers including Nomex and Kevlar, acrylic, polyvinylchloride, Hemp, among others. The second fibers and matrix typically have a stiffness of about 30 Shore A to about 80 Shore A and preferably about 40 Shore A to about 60 Shore A as measured by Durometer Hardness test method ASTM D2240. Typical materials suitable as the second fibers are Rayon, polyester, polypropylene, Nylon, acrylic, polyethylene, among others. The listed fibers are meant to be illustrative of the types that may be used, but the invention is not thereby limited to enumerated types. Preferably, the first fibers would have a higher stiffness than the second fibers.

The fibers are encapsulated in a matrix of a polymeric material. The first and second fibers can be encapsulated in the same or different matrix materials. Examples of suitable matrix materials are polyurethanes including polyester and polyether urethanes, polycarbonates, polyacrylates, polyaramides, and thermosetting polymers such as epoxies and derivatives of epoxies. The chemical-physical properties, hence the polishing performance, of the fiber matrix encapsulated material are governed by the types and sizes of the fibers and polymers, the fiber: polymer ratio, and the local and global distribution of polymer within the fiber matrix. For example, employing a larger fiber diameter (thus with fewer fibers for a given density of the fiber matrix) and the use of a high fiber: polymer ratio will result in an open cell pad structure having a lower overall density and higher compressibility. Conversely, employing a smaller fiber diameter, a lower fiber: polymer ratio, and harder polymer types will result in a closed cell structure having higher density, lower compressibility and higher hardness. The present design therefore offers a versatility of properties and performance required to give a high degree of planarization and global uniformity to a variety of polished substrates.

The pads of the present invention typically comprise about 30 to about 80 percent by weight and preferably about 40 to about 70 percent by weight of the fibers and correspondingly typically about 70 to about 20 percent by weight and preferably about 60 to about 30 percent by weight of the polymeric matrix. The percentages of the fibers and polymeric matrix are based upon the total of the fibers and polymeric matrix in the pad.

The pads of the present invention preferably have densities of about 0.3 g/cc to about 1.2 g/cc.

Typically, the layer(s) of the first stiffer fibers is thicker than the layer(s) of the second fibers used as the polishing surface and is more typically about 55% to about 90% of the total thickness of the pad. The first layer imparts mechanical stiffness to the pad. Multiple layers allow for independent optimization of pad stiffness and softness in independent layers. The stiffness of the support layer is preferably optimized in relation to the malleability of the material comprising the surface to be worked. The soft layer is preferably optimized with respect both to the properties of the surface to be buffed, and with respect to the chemical properties of the abrasive mixture used in the CMP process. The ratio of fibers to matrix controls the distribution of open porosity in the pads. A more uniform porosity and a higher density yields pads with better polishing uniformity, less dishing, and a higher polishing rate. This permits greater process throughput and greater product yields.

As indicated above, stacked nonwoven and other types of pads have been tried in an attempt to obtain better CMP performance. However, thin (5 to 15 mil thick) fibrous pads are not sufficiently durable and do not survive the CMP process. In the present invention, a plurality of fiber layers were bonded such that the top layer can be buffed down to 5 mils while still maintaining structural integrity during the CMP process. The thin, soft top layer provides a scratch-free polishing surface while the much stiffer bottom layer reduces the excessive dishing which usually occurs during CMP with thicker, softer pads similar to the top layer of the pad of the present invention.

According to preferred aspects of the present invention, the fibers are precoated with a polymer prior to being encapsulated in the matrix. Examples of polymers suitable for precoating the fibers are copolymers of styrene and an acrylate or methacrylate such as ethyl or methyl acrylate or methacrylate; acrylonitrile rubbers; and butadiene-styrene rubbers, urethanes, fluorocarbons, and epoxy resins.

The precoating maintains the stability of the fiber layers for enhancing adhesion to the matrix and can be used in amounts of about 10 to about 90% by weight and preferably about 15 to 50% by weight based upon the total weight of the fibers and precoating.

Thus the invention allows for independent control of the optimal properties to prevent over polishing, for compatibility with the substrate to be polished, and for compatibility with the polishing compound.

The pads of the present invention can be fabricated by forming a network of the layer(s) of the first fibers and then laying on top the first fibers a network of the layer(s) of the second fibers followed by applying a precoating, when used, to the fibrous network such as by spraying, and then curing the precoat. In the alternative, each of the fiber layers can separately be precoated and then partially curing the precoat such as to the B-stage. The separate layers are stacked upon each other heated to its final cure. At this stage, the structure is then encapsulated into the matrix. This can be accomplished by placing the structure in flat heated mold and applying a polymeric matrix material such as a viscous polyurethane on top of the structure. The mold is then closed and heat and pressure are applied causing the polymer to fill in the spaces between the fibers and encapsulate them. The curing of the matrix polymer is typically performed at temperatures of about 100 to about 120 F, a pressure of about 30 psi to about 200 psi, for about 5 to about 24 hours.

The pads of the present invention can be used for polishing aluminum and aluminum alloys (Al-Si, Al-Cu), Cu, Cu alloys, W, a variety of adhesion/diffusion barriers such as Ti, TiN, Ta, TaN, Cr and the like as well as other metals and alloys, or glass of various compositions.

The polishing slurries employed can be any of the known CMP slurries. Particular examples are alumina in deionized water, or an acidic composition having a pH less than 3 obtained by the addition of hydrofluoric or nitric acid to the alumina—water slurry; and slurries with pH 3 or greater, including basic slurries having pH above 7.

An embodiment, suitable for the semiconductor industry, is a substantially cylindrical pad having general dimensions such that it might be used in a polishing apparatus, for example in the equipment described in the *IBM Technical Disclosure Bulletin*, Vol. 15, No. 6, November 1972, pages 1760–1761. As an alternative embodiment, the polishing apparatus includes a polishing station having a rotatable platen on which is mounted a polishing pad. The pad in this embodiment is about 20 inches in diameter, thus capable of polishing "eight-inch" or "twelve-inch" semiconductor wafers. The platen typically rotates the pad at speeds from 30 to 200 revolutions per minute, though speeds less than and greater than this range may be used. Semiconductor wafers are typically mounted on a rotatable carrier head using a vacuum chuck. Typically the direction of rotation of the platen is of the opposite sense as that of the carrier head. The head presses the wafer against the pad causing polishing, for example with 2–8 pounds per square inch pressure, but greater or lesser pressures could also be used. The rate of polishing is controlled by the composition of the slurry, the rotation rates of the head and platen, and the contact pressure.

The following table summarizes and compares properties of pads according to the preset invention to prior art pads. The pads of the present invention are identified as A, B, C, and D.

TABLE 1

| Code Name | Thickness | Density | Binder/Fiber Ratio |
|---|---|---|---|
| A | 65 mils | 0.30 g/cc | 50%/50% |
| B | 54 mils | 0.40 g/cc | 50%/50% |
| C | 36 mils | 0.36 g/cc | 28%/72% |
| D | 39 mils | 0.38 g/cc | 40%/60% |

Polishing tests on Cu revealed that pads of the present invention provided improved results as compared to the Prior Art pads.

The foregoing description of the invention illustrates and describes the present invention. Additionally, the disclosure shows and describes only the preferred embodiments of the invention but, as mentioned above, it is to be understood that the invention is capable of use in various other combinations, modifications, and environments and is capable of changes or modifications within the scope of the inventive concept as expressed herein, commensurate with the above teachings and/or the skill or knowledge of the relevant art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

What is claimed is:

1. A pad comprising:

at least one first layer comprising first fibers in a first matrix and at least one second layer comprising second and different fibers embedded in a second matrix and acting as the polishing layer, wherein said first layer is stiffer than said second layer.

2. A pad, as in claim 1, wherein said first layer is formed by embedding a plurality of said first fibers in said first matrix;

said second layer is formed by embedding a plurality of said second fibers in said second matrix, and said second layer is bonded to said first layer.

3. A pad, as in claim 2, comprising a plurality of said first layers.

4. A pad, as in claim 1, wherein the first fibers and matrix have a stiffness of about 50 Shore A to about 100 Shore A and the second fibers and matrix have a stiffness of about 40 Shore A to about 90 Shore A.

5. A pad as in claim 1 wherein said first fibers comprise at least one member selected from the group consisting of polyester, rayon, polycarbonate, aramide, acrylic, polyvinylchloride, and hemp.

6. A pad as in claim 1 wherein said second fibers comprise at least one member selected from the group consisting of rayon, polyester, polypropylene, nylon, acrylic, and polyethylene.

7. A pad as in claim 1 which comprises about 50 to about 72 percent by weight of the fibers and correspondingly about 50 to about 28 percent by weight of said matrix, wherein the percentages of the fibers and polymeric matrix are based upon the total of the fibers and matrix in the pad.

8. A pad as in claim 1 having a density of about 0.3 g/cc to about 1.2 g/cc.

9. A pad as in claim 1 wherein the layer of the first fibers is thicker than the layer(s) of the second fibers used as the polishing surface.

10. A pad as in claim 1 wherein the layer of the first fibers is typically about 55% to about 90% of the total thickness of the pad.

11. A pad as in claim 1 wherein each said matrix comprises at least one member selected from the group consisting of polyurethanes, polyesterurethanes, polyetherurethanes, polycarbonates, polyacrylates, polyaramides, and thermosetting polymers.

12. A pad as in claim 1, wherein said first fibers are coated fibers.

13. A pad as in claim 12, wherein said second fibers are coated fibers.

14. A pad as in claim 13, wherein said first and second fibers are coated with a styrene-acrylate polymer.

* * * * *